US010844722B2

(12) United States Patent
Montes Parra

(10) Patent No.: US 10,844,722 B2
(45) Date of Patent: Nov. 24, 2020

(54) DELIBERATELY MISTUNED BLADED WHEEL

(71) Applicant: SAFRAN AIRCRAFT ENGINES, Paris (FR)

(72) Inventor: Roger Felipe Montes Parra, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 44 days.

(21) Appl. No.: 16/309,646

(22) PCT Filed: Jun. 14, 2017

(86) PCT No.: PCT/FR2017/051530
§ 371 (c)(1),
(2) Date: Dec. 13, 2018

(87) PCT Pub. No.: WO2017/216480
PCT Pub. Date: Dec. 21, 2017

(65) Prior Publication Data

US 2019/0330985 A1 Oct. 31, 2019

(30) Foreign Application Priority Data

Jun. 16, 2016 (FR) ..... 16 55622

(51) Int. Cl.
*F01D 5/10* (2006.01)
*F01D 5/14* (2006.01)

(52) U.S. Cl.
CPC ..... *F01D 5/10* (2013.01); *F01D 5/141* (2013.01); *F05D 2250/184* (2013.01)

(58) Field of Classification Search
CPC ... F01D 5/10; F01D 5/027; F01D 5/62; F01D 5/141; F05D 2250/184
See application file for complete search history.

(56) References Cited

U.S. PATENT DOCUMENTS 2,888,239 A * 5/1959 Slemmons ..... F01D 5/021 416/213 R
3,121,555 A * 2/1964 Aspinwall ..... F01D 5/021 416/244 R
3,262,676 A * 7/1966 Huebner, Jr. ..... F01D 5/30 416/244 R
8,342,804 B2 * 1/2013 Pronovost ..... F01D 5/027 416/144
8,356,975 B2 * 1/2013 Grover ..... F01D 9/02 415/191

(Continued)

FOREIGN PATENT DOCUMENTS

FR 2 959 535 A1 11/2011
WO 2008/041889 A1 4/2008

OTHER PUBLICATIONS

International Search Report of PCT/FR2017/051530 dated Oct. 5, 2017.

*Primary Examiner* — Igor Kershteyn
(74) *Attorney, Agent, or Firm* — Sughrue Mion, PLLC

(57) ABSTRACT

A bladed wheel of a turbomachine includes a disk extending around a longitudinal axis, in a median plane, and blades distributed regularly around the longitudinal axis and extending radially from the disk. The disk includes a web corrugated alternately upstream and downstream of the median plane, so as to introduce a deliberate detuning of the bladed wheel.

17 Claims, 5 Drawing Sheets

(56) References Cited

U.S. PATENT DOCUMENTS

| | | | | |
|---|---|---|---|---|
| 8,757,979 | B2 * | 6/2014 | Martensson | F01D 5/10 310/51 |
| 9,683,447 | B2 * | 6/2017 | Gentile | F01D 5/26 |
| 9,863,251 | B2 * | 1/2018 | Mahle | F01D 11/08 |
| 9,976,433 | B2 * | 5/2018 | Praisner | F01D 11/00 |
| 2005/0100439 | A1 * | 5/2005 | Greim | F01D 5/225 415/173.5 |
| 2010/0074752 | A1 | 3/2010 | Denis et al. | |
| 2010/0080705 | A1 | 4/2010 | Pronovost et al. | |
| 2011/0274540 | A1 | 11/2011 | Froissart et al. | |
| 2015/0292337 | A1 | 10/2015 | Gentile et al. | |

* cited by examiner

DELIBERATELY MISTUNED BLADED WHEEL

CROSS REFERENCE TO RELATED APPLICATIONS

This application is a National Stage of International Application No. PCT/FR2017/051530 filed Jun. 14, 2017, claiming priority based on French Patent Application No. 16 55622 filed Jun. 16, 2016, the disclosures of each of which are herein incorporated by reference in their entireties.

GENERAL TECHNICAL FIELD

The present invention relates to a deliberately mistuned bladed wheel of a turbomachine.

PRIOR ART

A turbomachine generally comprises, from upstream to downstream in the gas flow direction, a fan, one or more compressor stages, for example a low-pressure compressor and a high-pressure compressor, a combustion chamber, one or more turbine stages, for example a high-pressure turbine and a low-pressure turbine, and a gas exhaust nozzle.

Each compressor or turbine stage is formed of guide blades or a stator and rotating blades or a rotor around a main axis of the turbomachine.

Each rotor conventionally comprises a disk extending around the main axis of the turbomachine and comprising an annular platform, as well as a plurality of blades distributed regularly around the main axis of the turbomachine and extending radially with respect to this axis from an exterior surface of the platform of the disk. These are also called "bladed wheels."

Bladed wheels are subject to multiple vibrational phenomena, the sources of which can be aerodynamic and/or mechanical.

What concerns us most particularly here is flutter, which is a vibrational phenomenon with an aerodynamic source. Flutter is linked to the interaction between the blades and the fluid passing through them. In fact, when the turbomachine is operating, the blades, while the fluid is passing through them, modify its flow. In return, the modification of the flow of the fluid passing through the blades has the effect of exciting them in vibration. However, when the blades are excited in the vicinity of their natural vibration frequency, this coupling between the fluid and the blades can become unstable; this is the flutter phenomenon. This phenomenon then manifests itself as blade oscillations of increasing amplitude which can lead to cracks, or worse to the destruction of the bladed wheel.

This phenomenon is therefore very dangerous and it is vital to avoid having the coupling between the fluid and the blades become unstable.

In order to mitigate this problem, it is known to "deliberately mistune" the bladed wheels. The deliberate mistuning of a bladed wheel consists of using the cyclic symmetry of the bladed wheel, namely the fact that the bladed wheels are generally composed of a series of geometrically identical sectors, and to create a frequency disparity between all the blades of said bladed wheel. In other words, the deliberate mistuning of a bladed wheel consists of introducing variations between the natural frequencies of vibration of the blades of said bladed wheel. Such a frequency disparity allows stabilizing the bladed wheel with respect to flutter by increasing its aero-elastic damping.

"Deliberate detuning" is different from "accidental detuning" which for its part is the result of small geometric variations of the bladed wheels or to small variations in the characteristics of the material which constitutes them, generally caused by tolerances in manufacturing and assembly, which can lead to small variations in natural vibration frequencies from one blade to another.

Several solutions have already been offered for deliberately detuning a bladed wheel.

Document FR 2 869 069 describes for example a method for introducing deliberate detuning in a bladed wheel of a turbomachine determined so as to reduce the vibrational levels of the wheel in forced response, characterized by the fact that it consists of determining, depending on the operating conditions of the wheel in the interior of the turbomachine, an optimum typical divergence value with respect to the maximum vibration amplitude response desired on the wheel, positioning on said wheel, at least partly, blades with different natural frequencies so that the distribution of frequencies of the set of blades has a typical divergence at least equal to said detuning value. This document also proposes several technical solutions for modifying the natural frequencies of vibration from one blade to another, among them the fact of using different material for the blades or the fact of acting on their geometry, for example by using blades of different lengths.

However, these technical solutions have the disadvantage of modifying the aerodynamic performance of the blades. These technical solutions therefore have an unfavorable effect on the performance of the turbomachine.

Another example is described in document US 2015/0198047. This document describes a bladed wheel comprising alternately blades formed based on a first titanium alloy, and blades formed based on a second titanium alloy, the first and second titanium alloys inducing different natural vibration frequencies of the blades.

As for the solution proposed in document FR 2 869 069, this solution has the disadvantage of perturbing the aerodynamic performance of the blades and therefore of degrading the performance of the turbomachine.

PRESENTATION OF THE INVENTION

The present invention has the objective, in particular, of mitigating the deliberate mistuning techniques of the prior art.

More precisely, the present invention has as its object a bladed wheel of a turbomachine comprising a disk extending around a longitudinal axis, in a median plane, and a plurality of blades distributed regularly around said longitudinal axis and extending radially from the disk, the disk comprising a web corrugated alternately upstream and downstream of the median plane, so as to introduce a deliberate detuning of the bladed wheel.

Preferably, the corrugations of the web of the disk follow each other along a line extending in the median plane and surrounding the longitudinal axis.

Preferably, in half-periods defined between two consecutive points of the web disposed in the median plane and corresponding to a median thickness of the web, the corrugations of the web of the disk being are defined based on a curve representing a polynomial function of degree 2.

Preferably, the corrugations of the web of the disk have a constant period.

Preferably, the number of periods accomplished by the corrugations of the web of the disk over 360° around the longitudinal axis is even.

Preferably, the corrugations of the web of the disk has the same maximum amplitude.

The invention also has as its object a turbomachine compressor, turbine or fan comprising a bladed wheel as previously described, as well as a turbomachine comprising such a compressor, such a turbine or such a fan.

PRESENTATION OF THE FIGURES

Other features, aims and advantages of the present invention will appear upon reading the detailed description which follows, and with reference to the appended drawings given by way of non-limiting examples and in which:

FIG. 1 is a schematic view, in longitudinal section, of a double flow turbomachine;

FIGS. 2*a* to 2*c* are respectively a front view and perspective views of a bladed wheel according to one embodiment of the invention;

DETAILED DESCRIPTION

Figure 1:
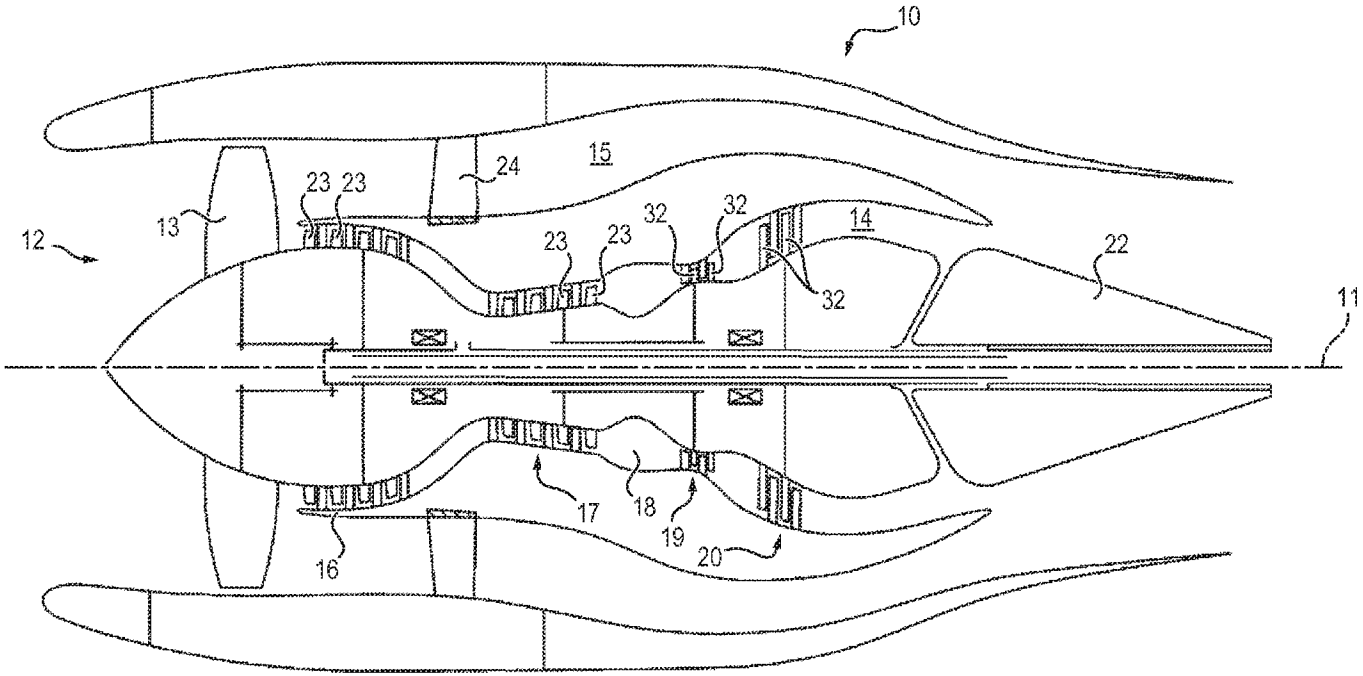

FIG. 1 illustrates a double flow turbomachine 10. The turbomachine 10 extends along a main axis 11 and comprises an air duct 12 by which a flow of gas penetrates into the turbomachine 10 and in which the gas flow passes through a fan 13. Downstream of the fan 13, the flow of gas separates into a primary gas flow flowing in a primary flow path 14 and a secondary gas flow flowing in a secondary flow path 15.

In the primary flow path 14, the primary flow passes, from upstream to downstream, through a low-pressure compressor 16, a high-pressure compressor 17, a combustion chamber 18, a high-pressure turbine 17, a combustion chamber 18, a high-pressure turbine 19, a low-pressure turbine 20 and a gas exhaust casing to which an exhaust nozzle 22 is connected. In the secondary flow path 15, the secondary flow passes through guide blades or a fan straightener 24, and is then mixed with the primary flow at the exhaust nozzle 22.

Each compressor 16, 17 of the turbomachine 10 comprises several stages, each stage being formed by guide blades or a stator and rotating blades or a rotor 23 around the main axis 11 of the turbomachine 10. The rotating blades or rotor 23 is also called a "bladed wheel."

Figure 2A:
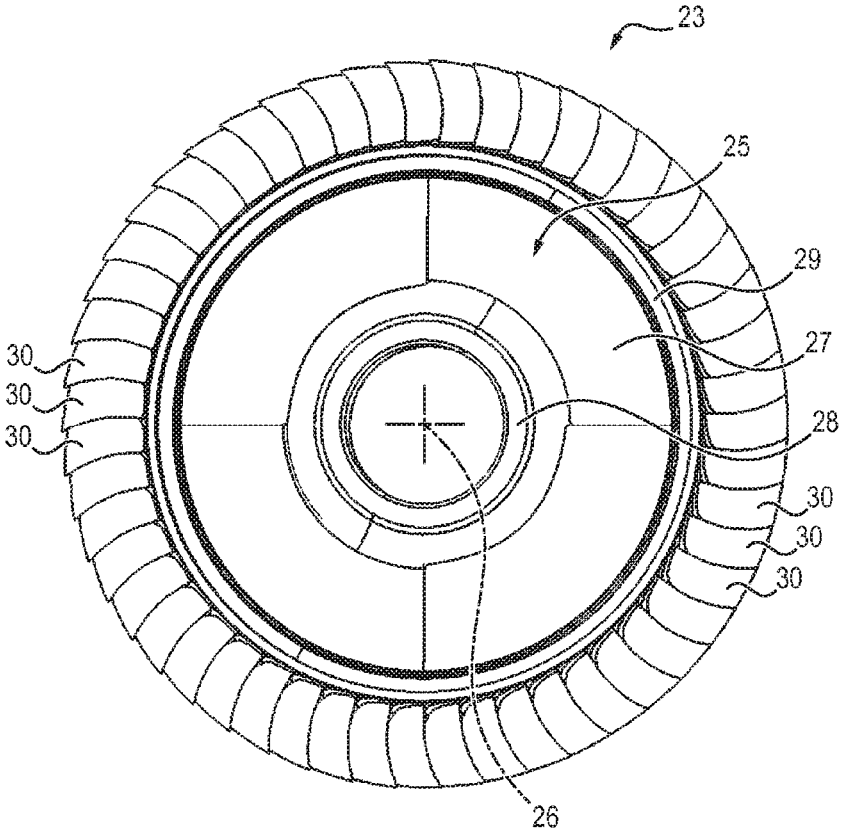
Figure 2B:
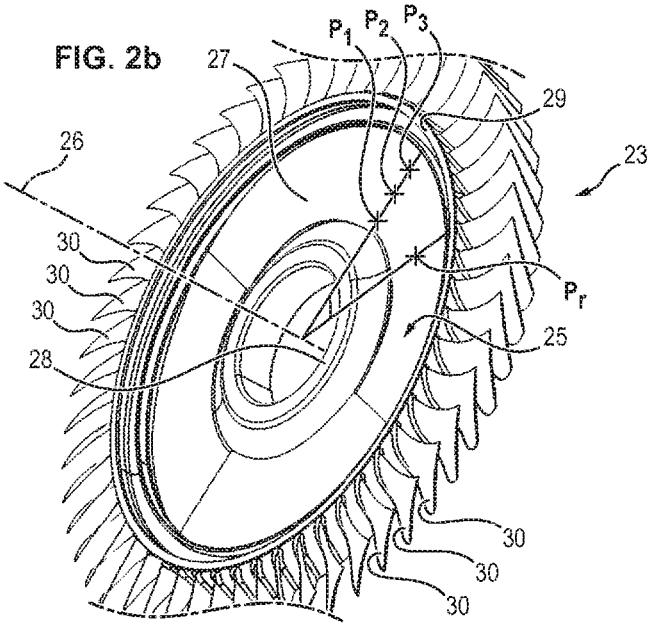
Figure 2C:
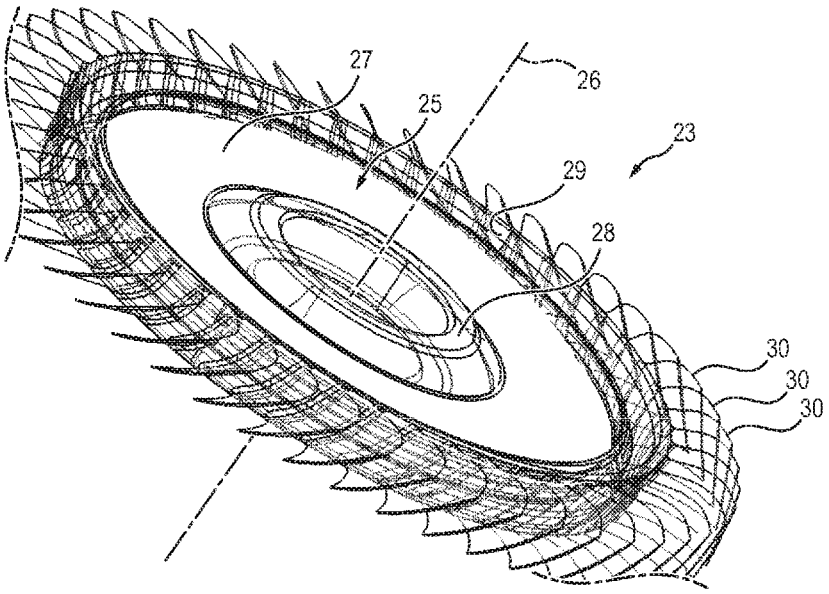

FIGS. 2*a* to 2*c* show different views of a bladed wheel 23 according to one embodiment of the invention.

The bladed wheel 23 comprises a disk 25 arranged in a median plane PM and extending around a longitudinal axis 26 which, when the bladed wheel 23 is assembled in the turbomachine 10, is conflated with the main axis 11 of said turbomachine 10.

The disk 25 comprises a web 27 provided between a radially internal hub 28 by means of which the bladed wheel 23 is mounted in rotation around the main axis 11 of the turbomachine 10 and an annular platform 29 arranged at the external periphery of the disk 25. The web 27 has a substantially constant thickness. What is meant by "thickness" is the dimension of the web 27 disposed along the longitudinal axis 26. What is meant by "substantially constant" is that the web 27 is of constant thickness within the limits of error, i.e. within 0.1 mm.

The bladed wheel 23 also comprises a plurality of blades 30 distributed regularly around the longitudinal axis 26 and extending radially with respect to this axis 26 from the platform 29. The blades 30 can be one-piece with the disk 25 of be applied to the disk 25 by means well known to a person skilled in the art.

Figure 3:
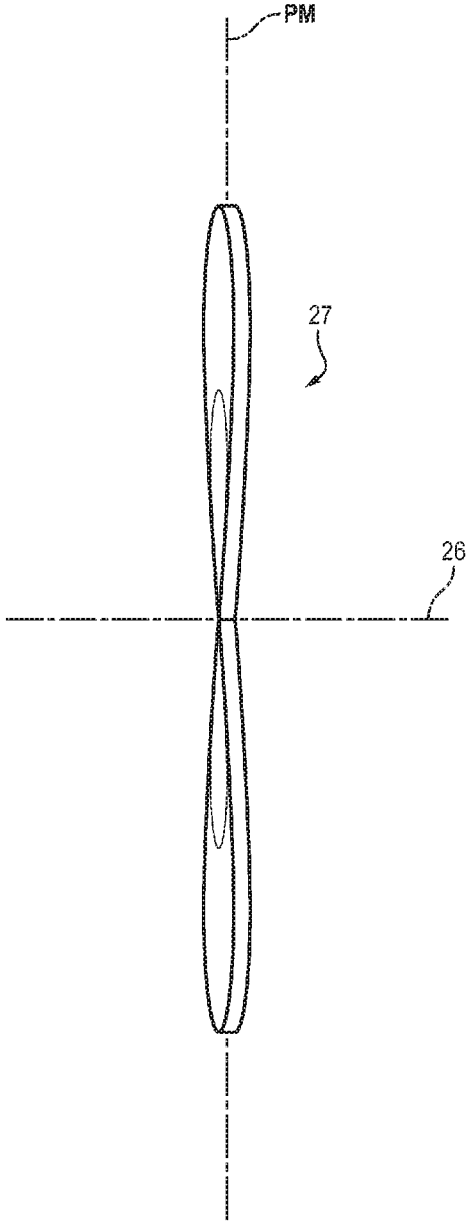
FIG. 3 is a profile view of a web of the bladed wheel illustrated in FIGS. 2*a* to 2*c;*

FIG. 3 shows a profile view of the web 27 of the bladed wheel 23 illustrated in FIGS. 2*a* to 2*c*.

The web 27 of the disk 25 is corrugated alternately upstream and downstream from the median plane MP. In other words, the web 27 alternately has an offset with respect to the median plane PM in one direction, then in the other along the longitudinal axis 26.

Generally, bladed wheels have cyclic symmetry. In other words, bladed wheels are composed of a series of geometrically identical sectors which are repeated in a circular manner. This cyclic symmetry has an effect on the vibrational behavior of bladed wheels. In fact, bladed wheels have among their modal deformations rotating modal deformations which are the combination of two stationary deformation waves.

The corrugations of the web 27 allow modification of the circumferential distribution of stiffness of the disk 25 and thus achieve frequency separation between the two stationary deformation waves of the same rotating modal distortion of the bladed wheel 23, the frequency separation between two stationary deformation waves of the same rotation modal deformation of the bladed wheel 23 introduces a resistance to the circular propagation of a vibrational instability of a blade 30 or of a cluster of adjacent blades 30. Consequently, this frequency separation allows stabilizing the bladed wheel 23 with respect to flutter by increasing its aero-elastic damping. Moreover, the corrugations of the web 27 break the cyclic symmetry of the bladed wheel 23, which has the effect of limiting the energy of the rotating modal deformations and therefore also of stabilizing the bladed wheel 23 with respect to flutter. The corrugations of the web 27 therefore allow the introduction of a deliberate mistuning of the bladed wheel 23.

The present invention therefore takes advantage of the strong dynamic coupling between the blades 30 and the disk 25 to induce a frequency disparity between the blades 30 by modifying the geometry of the disk 25. The more the target modal deformation forces the disk 25, particularly the web 27, to participate, the greater the frequency separation.

Moreover, by not modifying the geometry or the material of the blades 30, an impact on their aerodynamic performance is avoided.

The corrugations of the web 27 of the disk 25 follow one another along a line extending in the median plane PM and surround the longitudinal axis 26. In order words, the corrugations of the web 27 follow each other in a circular manner around the longitudinal axis 26. The points of the web 27 which are disposed at the same thickness of the web 27 and which are disposed at the same angle θ, with respect to the longitudinal axis 26, of any reference point disposed at the same thickness have the same offset with respect to the median plane PM along the longitudinal axis 26. This angle θ represents the tangential coordinate. The corrugations of the web 27 therefore do not vary as a function of the radius—of the radial coordinate—of the web 27 where the observer is positioned.

By way of an example, points $P_1$, $P_2$ and $P_3$ with the same tangential coordinate have been placed in FIG. 2*b* and a reference point Pr selected arbitrarily in order to illustrate their tangential coordinate 8.

Figure 4:
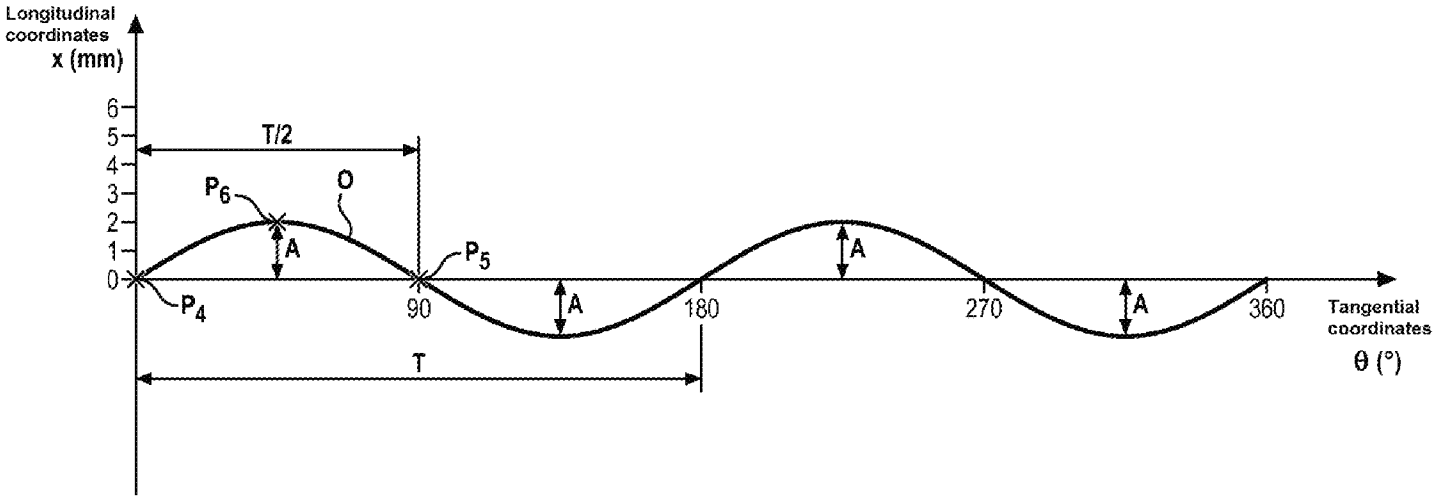
FIG. 4 is a graphic showing corrugations of the web illustrated in FIG. 3.

FIG. 4 shows a graph on which are shown the corrugations O of the web 27 of the bladed wheel 23. The graph shows respectively in the abscissa and in the ordinate the tangential 8 and longitudinal x coordinates of the corrugations O of the web 27, at a median thickness of the web 27 and at a fixed and random radial coordinate. The axis of the abscissa of the graph corresponds to a line extending in the median plane PM and surrounding the longitudinal axis 26 at a random radius.

The corrugations O of the web 27 of the disk 25 preferably have a constant period T. In the example illustrated in FIG. 4, the period T corresponds to 180°. Thus, the corrugations O of the web 27 of the disk 25 perturb only minimally the static and dynamic balance of the bladed wheel 23.

The number of periods T accomplished by the corrugations over 360° around the longitudinal axis 26 is preferably even. In the example illustrated in FIG. 4, the web 27 corrugates over two periods T. Thus, the corrugations O of the web 27 of the disk 25 perturb only minimally the static and dynamic balance of the bladed wheel 23. It will be understood that the number of periods T is not limited to two periods T, but that it depends on the size of the bladed wheel 23 concerned and the relative limits of manufacture of the corrugated web 27.

In each of the half-periods T/2 defined between two points of the web 27 disposed in the median plane PM and corresponding to the median thickness of the web 27, the corrugations O are defined based on a curve representing a polynomial function of degree 2. For that purpose, a curve representing a polynomial of degree 2 is for example interpolated in each of the half-periods T/2, based on said two points of the web 27 disposed in the median plane PM and corresponding to the median thickness and to another point corresponding to the maximum amplitude A and to the medial thickness of the web 27. Placed by way of an example in FIG. 4, for the first half-period T/2, are points $P_4$, $P_5$ disposed in the median plane PM and a point $P_6$ corresponding the maximum amplitude A. This has the advantage of facilitating the manufacture of the web 27 and therefore of the bladed wheel 23, in particular when manufacture is carried out by means of manufacturing machines assisted by unsophisticated computers.

The corrugations O of the web 27 can have different maximum amplitudes. In this case, the corrugations of period T which are diametrically opposed have the same maximum amplitude, so as to minimize the impact of said corrugations on the static and dynamic balance of the bladed wheel 23. Preferably, however, the corrugations O have the same maximum amplitude A in each half-period T/2, as illustrated in FIG. 4. This allows the static and dynamic balance of the bladed wheel 23 to be retained. The maximum amplitude A is for example less than or equal to half the thickness of the platform 29. What is meant by "thickness" is the dimension of the platform 29 disposed along the longitudinal axis 26.

The table below presents the results obtained in the first two modal deformations for two bladed wheels 23 conforming to the invention. The first of the bladed wheels 23 has corrugations of period T equal to 180° and maximum amplitude A equal to 1.8 mm. The second of the bladed wheels 23 has corrugations of period T equal to 180° and maximum amplitude A equal to 3.6 mm.

| Modal | Stationary | Bladed wheel 1 | | Bladed wheel 2 | |
|---|---|---|---|---|---|
| defor-mation | deformation wave | Frequency (Hz) | Detuning (%) | Frequency (Hz) | Detuning (%) |
| 1 | 1 | 460 | 0.3 | 395 | 0.7 |
| | 2 | 462 | | 398 | |

-continued

| Modal | Stationary | Bladed wheel 1 | | Bladed wheel 2 | |
|---|---|---|---|---|---|
| defor-mation | deformation wave | Frequency (Hz) | Detuning (%) | Frequency (Hz) | Detuning (%) |
| 2 | 1 | 546 | 1.0 | 487 | 0.9 |
| | 2 | 551 | | 491 | |

It is revealed by this table that with the corrugations of the web 27 of the disk 25 of the bladed wheels 23, the frequency of the two stationary deformation waves for each of the first and second modal deformations of these bladed wheels 23 is different. The corrugations of the web 27 of the disk 25 thus do allow obtaining a frequency separation between the two stationary deformation waves of the first and second modal deformation of the bladed wheels 23 and thereby introduce a deliberate detuning of said bladed wheels 23.

Manufacturing tolerances generally result in divergences of frequency on the order of 0.3% between the two stationary deformation waves of the modal deformations of the bladed wheels 23. This corresponds to an accidental detuning. In order to cover the deliberate detuning, it is desired for example to obtain a deliberate detuning which is a minimum of two times higher than the accidental detuning. Thus, for the first bladed wheel 23, the deliberate detuning obtained for the first modal deformation which is 0.3% is too low and would therefore be unacceptable if the first modal deformation was specifically the target for the deliberate detuning. On the other hand, it allows obtaining a frequency separation of 1.0% for the second modal deformation, which is above the minimum required. The deliberate detuning of the first bladed wheel 23 is therefore particularly appropriate if it is the second modal deformation which is the target for the deliberate detuning. It will therefore be understood that this is a compromise, which depends on the modal deformation which is the target.

The present invention is described below by referring to a bladed wheel 23 of a compressor 16, 17 of a turbomachine 10. However, the invention applies in the same manner to a rotor 32 of a turbine 19, 20 or to a fan 13, in that these bladed wheels can also be confronted with troublesome vibrational phenomena, such as flutter.

The invention claimed is:

1. A bladed wheel of a turbomachine comprising a disk extending around a longitudinal axis, in a median plane, and a plurality of blades distributed regularly around said longitudinal axis and extending radially from the disk, wherein the disk comprises a web corrugated alternately upstream and downstream of the median plane, so as to introduce a deliberate detuning of the bladed wheel, wherein, in half-periods defined between two consecutive points of the web disposed in the median plane and corresponding to a median thickness of the web, corrugations of the web of the disk are defined based on a curve representing a polynomial function of degree 2.

2. The bladed wheel according to claim 1, wherein the corrugations of the web of the disk follow each other along a line extending in the median plane and surrounding the longitudinal axis.

3. The bladed wheel according to claim 2, wherein the corrugations of the web of the disk have a constant period.

4. The bladed wheel according to claim 3, wherein a number of periods accomplished by the corrugations of the web of the disk over 360° around the longitudinal axis is even.

5. The bladed wheel according to claim 1, wherein the corrugations of the web of the disk have a same maximum amplitude.

6. A compressor of a turbomachine comprising a bladed wheel according to claim 1.

7. A turbine of a turbomachine comprising a bladed wheel according to claim 1.

8. A fan of a turbomachine comprising a bladed wheel according to claim 1.

9. A turbomachine comprising a compressor according to claim 6.

10. A turbomachine comprising a turbine according to claim 7.

11. A turbomachine comprising a fan according to claim 8.

12. A bladed wheel of a turbomachine comprising a disk extending around a longitudinal axis, in a median plane, and a plurality of blades distributed regularly around said longitudinal axis and extending radially from the disk, wherein the disk comprises a web corrugated alternately upstream and downstream of the median plane, so as to introduce a deliberate detuning of the bladed wheel, wherein the web is configured to be provided between a radially internal hub by which the bladed wheel is mounted in rotation around the longitudinal axis of the turbomachine and an annular platform arranged at an external periphery of the disk, wherein corrugations of the web of the disk do not vary as a function of a radial coordinate of the web.

13. The bladed wheel according to claim 12, wherein the corrugations of the web of the disk follow each other along a line extending in the median plane and surrounding the longitudinal axis.

14. The bladed wheel according to claim 12, wherein, in half-periods defined between two consecutive points of the web disposed in the median plane and corresponding to a median thickness of the web, corrugations of the web of the disk are defined based on a curve representing a polynomial function of degree 2.

15. The bladed wheel according to claim 13, wherein the corrugations of the web of the disk have a constant period.

16. The bladed wheel according to claim 15, wherein a number of periods accomplished by the corrugations of the web of the disk over 360° around the longitudinal axis is even.

17. The bladed wheel according to claim 12, wherein the corrugations of the web of the disk have a same maximum amplitude.

* * * * *